US010306939B2

(12) United States Patent
Huang et al.

(10) Patent No.: US 10,306,939 B2
(45) Date of Patent: Jun. 4, 2019

(54) PANTS WITH HIDDEN LEG POCKET

(71) Applicant: Yu Jane Huang, Beverly Hills, CA (US)

(72) Inventors: Kuang Chou Huang, Beverly Hills, CA (US); Yu Jane Huang, Beverly Hills, CA (US)

( * ) Notice: Subject to any disclaimer, the term of this patent is extended or adjusted under 35 U.S.C. 154(b) by 0 days.

(21) Appl. No.: 16/032,849

(22) Filed: Jul. 11, 2018

(65) Prior Publication Data

US 2019/0116901 A1 Apr. 25, 2019

(30) Foreign Application Priority Data

Oct. 24, 2017 (CN) ..... 2017 2 1384485

(51) Int. Cl.
*A41D 27/20* (2006.01)
*A41D 1/06* (2006.01)

(52) U.S. Cl.
CPC ..... *A41D 27/205* (2013.01); *A41D 1/06* (2013.01); *A41D 2300/30* (2013.01)

(58) Field of Classification Search
CPC ... A41D 1/06; A41D 1/02; A41D 1/04; A41D 3/00; A41D 2600/102; A41D 27/20; A41D 27/205; B62J 2027/005
USPC ..... 2/247, 249, 250
See application file for complete search history.

(56) References Cited

U.S. PATENT DOCUMENTS 3,784,986 A * 1/1974 Klaproth ..... A41D 1/06 2/237
4,079,871 A * 3/1978 Sica ..... A45C 11/00 224/677
4,498,200 A * 2/1985 Livingstone ..... A41D 27/20 2/211
5,090,053 A * 2/1992 Hayes ..... A41D 13/0053 2/2.5
5,182,815 A * 2/1993 Young ..... A41B 9/004 2/228
5,410,746 A * 4/1995 Gelber ..... A42B 1/245 2/209.13
5,445,114 A * 8/1995 Walker ..... A63B 21/065 119/857
6,050,364 A * 4/2000 Popall ..... A62B 35/0031 182/6
6,161,222 A * 12/2000 Strickland ..... A41D 1/089 2/228
6,178,559 B1 * 1/2001 Dennis ..... A41B 9/001 2/114
6,244,379 B1 * 6/2001 Larson ..... A41D 13/0007 182/6

(Continued)

*Primary Examiner* — Shaun R Hurley
*Assistant Examiner* — Bao-Thieu L Nguyen
(74) *Attorney, Agent, or Firm* — Fish IP Law, LLP

(57) ABSTRACT

The inventive subject matter provides apparatus, systems and methods in which pants have at least a hidden pocket near the end of a pant leg. The hidden pocket has a sealable opening, preferably downward-facing, on the inside of pant leg that is easily assessable from the end of the pant leg. In preferred embodiments, pants have two pockets on each of the pant legs that are connected by a cable which is at least partially covered by a rubber band. The rubber band can be covered by a soft and fluffy material (e.g., velvet). In some embodiments, the pocket has a metalized layer that would at least partially shield the user from electromagnetic radiation produced by an electronic device.

18 Claims, 7 Drawing Sheets

(56) References Cited

U.S. PATENT DOCUMENTS 6,295,650 B1 * 10/2001 Baacke ..... A41D 13/0012 2/462
7,171,695 B2 * 2/2007 Braun ..... A41D 27/28 2/247
7,376,979 B2 * 5/2008 Nilsen ..... A63B 21/065 2/69
7,673,348 B2 * 3/2010 Williams ..... A41D 1/005 2/115
7,967,109 B2 * 6/2011 Petzl ..... A62B 35/0037 182/3
8,024,819 B2 * 9/2011 Gearhart ..... A41C 1/006 2/238
8,272,073 B2 * 9/2012 Arensdorf ..... A41D 1/08 2/228
8,486,035 B1 * 7/2013 Arce ..... A61F 5/449 2/227
9,149,073 B1 * 10/2015 Hirshberg ..... A41B 5/00
9,205,965 B2 * 12/2015 Vanlandingham ... B65D 75/008
2001/0052532 A1 * 12/2001 Perez ..... A41D 13/0012 224/575
2005/0000001 A1 * 1/2005 Goldkind ..... A41D 11/00 2/227
2006/0150298 A1 * 7/2006 Jones ..... A41D 3/00 2/93
2006/0156450 A1 * 7/2006 McGrath ..... A41D 10/00 2/114
2009/0320184 A1 * 12/2009 Schaefer ..... A41B 9/02 2/405
2010/0035510 A1 * 2/2010 Joubert Nogueroles ..... A63H 3/02 446/370
2011/0247127 A1 * 10/2011 Pou ..... A41D 13/0012 2/227
2014/0005010 A1 * 1/2014 Kaminsky ..... A63B 21/065 482/105
2014/0130243 A1 * 5/2014 Falken ..... A41D 27/204 2/455
2014/0157484 A1 * 6/2014 Ezell ..... A41D 13/0058 2/102
2014/0259299 A1 * 9/2014 Sievwright ..... A41D 27/20 2/252
2015/0007379 A1 * 1/2015 Cockram ..... A41D 1/06 2/236
2015/0074866 A1 * 3/2015 Diakite ..... A41D 27/208 2/69
2016/0015104 A1 * 1/2016 Edwards ..... A41D 1/002 2/94
2016/0095372 A1 * 4/2016 Peterson ..... A41D 27/201 2/248
2016/0291162 A1 * 10/2016 Larkins ..... A41D 1/002
2016/0346589 A1 * 12/2016 Emick ..... A63B 21/152
2017/0231290 A1 * 8/2017 Jensen ..... A41B 15/00 2/249
2017/0238622 A1 * 8/2017 Christopher ..... A41C 1/003
2018/0168250 A1 * 6/2018 Ly ..... A41D 1/06

* cited by examiner

PANTS WITH HIDDEN LEG POCKET

This application claims the benefit of priority of Chinese Patent Application No. 201721384485.4, filed on Oct. 24, 2017. This and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is pants with hidden pockets.

BACKGROUND

The following description includes information that may be useful in understanding the present invention. It is not an admission that any of the information provided herein is prior art or relevant to the presently claimed invention, or that any publication specifically or implicitly referenced is prior art.

Many people prefer to carry small electronic devices (e.g., mobile phones) in the front or back pockets of their pants when they are not using the electronic device. However, there are several problems associated using the traditional design of pant pockets to carry electronic devices. First, it can be uncomfortable, since the electronic device can get in the way during movement (e.g., when sitting down). Second, for pockets that are relatively small, the carried device can easily fall out or be stolen due to pick-pocketing. Third, often the pockets are too small to simultaneously hold an electronic device and an ancillary device (e.g., a portable power source) that needs to be connected with the electronic device.

To avoid the problem of pick-pocketing, prior work has attempted to design pants having hidden pockets. See e.g., CN201468046U (Tang), CN202958857U (Dang), U.S. Pat. No. 8,745,767 (Moghaddas), U.S. Pat. No. 8,707,469 (Moghaddas), U.S. Pat. No. 8,745,768 (Moghaddas), US20120185999 (Raviv), U.S. Pat. No. 9,247,776 (Kim), and US20150089716 (Gonzales). Although these pockets are more hidden compared to traditional pant pockets, they still have openings assessable from the outside, and can therefore be accessed by thieves once the pockets are spotted. Moreover, such pockets are positioned around the waist or the crotch, and would therefore bend when the user sits down. This would make the user feel uncomfortable because the rigid electronic device would be compressed, creating tension in the pocket and limiting the user's movement.

Other pockets are positioned further from the waist, for example, U.S. Design patents U.S. D792681 and U.S. D804147 teach pockets in one of the pant legs. But these pockets are located in the middle of the pant leg, and are not readily accessible. Moreover, they have openings on the outside, which can be accessed through a flap that can be targeted by thieves or robbers. US20120117713 (Hoffner) teaches hidden pockets located inside pants on a separate sleeve. But the sleeve can be inconvenient and uncomfortable, and once again, the interior pockets are not easily accessible.

Thus, there is still a need for pant pockets that are generally undetectable from the outside, easily accessed only by the wearer, and can comfortably hold an electronic device.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

SUMMARY OF THE INVENTION

The inventive subject matter provides apparatus, systems and methods in which pants have hidden pockets, near the end of, and inside of, one or both of the pant legs.

The pant legs can be any suitable length. In preferred embodiments, the pant legs have a length of no more than 40 cm. In preferred embodiments, the pocket has a cavity typically of the size of a mobile electronic device (e.g., a mobile phone). The pocket can have an opening facing upward, downward, or sideways. It is also contemplated for the pocket to have more than one opening, for example, a bottom opening and a side opening, or two side openings, or a bottom opening and a top opening, or any other combination thereof.

When worn, the pocket is preferably location on the front (anterior) portion of the leg, but could alternatively be located on a lateral, medial, or posterior side of the leg. In preferred embodiments, the pocket is located close to the bottom of the pant leg and has an opening facing downward, so that the pocket is easily accessed from the bottom especially with the help of gravity. Preferably, the opening is less than 10 cm from the bottom of the pant leg. More preferably, the opening is less than 5 cm from the bottom of the pant leg. The opening can be at least partially closed by a flap, a zipper, a button, a hook and loop fastener, or any other suitable mechanism.

In preferred embodiments, pants have one pocket on each of the pant legs, which are connected by a cable. In especially preferred embodiments, the cable coincides with a crotch folding line of the pants, such that the cable will not be felt by the user's legs. The cable can be stabilized by one or more fixing members, and is at least partially covered by a rubber layer with a crescent shaped cross-section that insulated the user from the cable. The rubber layer can advantageously be covered by a soft material (e.g., fleece), to make the user feel comfortable.

In some embodiments, a pocket has a layer, preferably metalized, that would at least partially shield the user from electromagnetic radiation or other hazardous radiation, substance or material produced by an electronic device in the pocket.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1A:
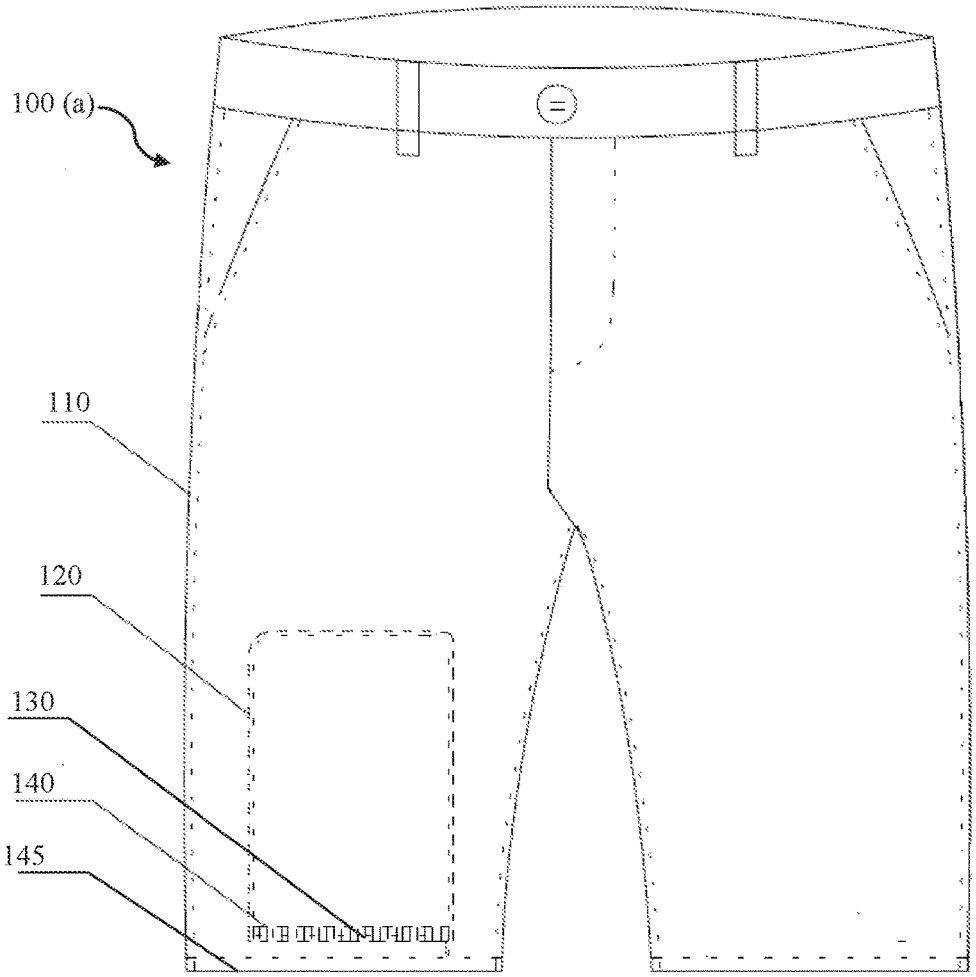
FIG. 1*a* shows a pair of pants with a pocket with a downward-facing opening on the inside of the pant leg.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

Throughout the following discussion, numerous references will be made regarding servers, services, interfaces, portals, platforms, or other systems formed from computing devices. It should be appreciated that the use of such terms is deemed to represent one or more computing devices having at least one processor configured to execute software instructions stored on a computer readable tangible, non-transitory medium. For example, a server can include one or more computers operating as a web server, database server, or other type of computer server in a manner to fulfill described roles, responsibilities, or functions.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

As used herein, the term "pants" or "a pair of pants" means an outer garment covering each leg separately, either entirely or partially. By this definition, culottes are considered to be pants, as well as Bermuda shorts, cargo shorts, cycling shorts, and Capri pants. But other than skorts, skirts are not considered to be pants because they do not have separate legs. In preferred embodiments, the coverage of the pants extends from the waist to above the knees. In other embodiments, the coverage of the pants extends from the waist to or below the knees, and even in some cases down to the ankles. As used herein, the term "shorts" or "a pair of shorts" means pants with coverage extending to at most 15 cm below the knees, and therefore not covering the entire length of the legs.

FIG. 1*a* is an embodiment of a pair of pants 100(*a*) that has a pocket 120 on the inside of a pant leg 110. Pocket 120 has a downward facing opening 130 that can be at least partially closed by a zipper 140. The opening 130 is less than 10 cm from the bottom 145 of the pant leg 110, so that the zipper 140 can be easily accessed from the bottom 145.

Figure 1B:
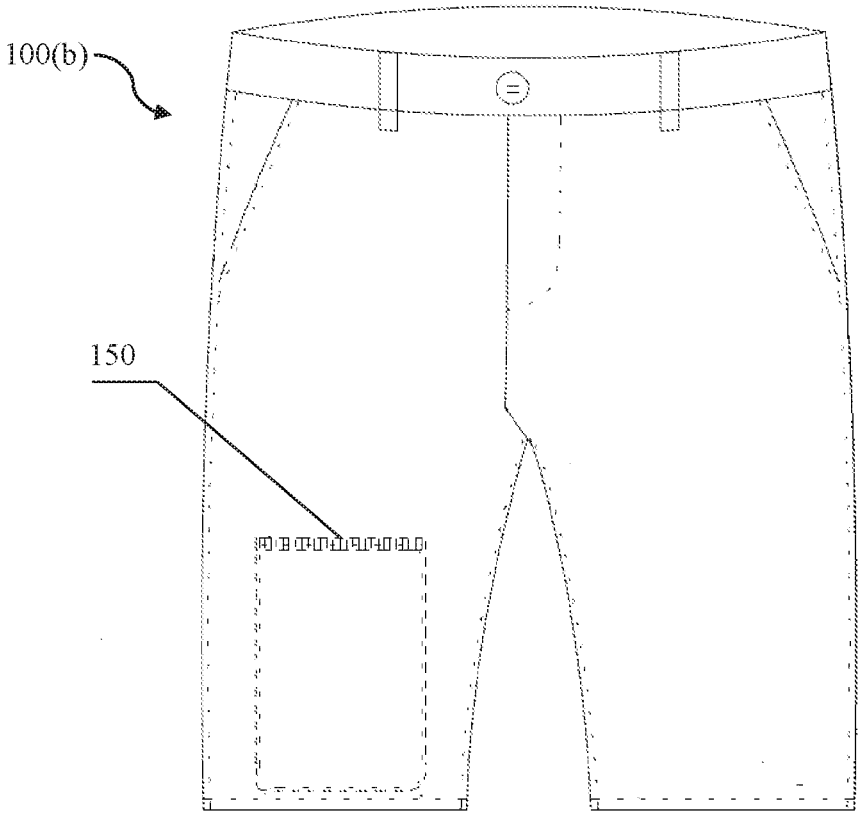
FIG. 1*b* shows a pair of pants with a pocket with an up-facing opening on the inside of the pant leg.
Figure 1C:
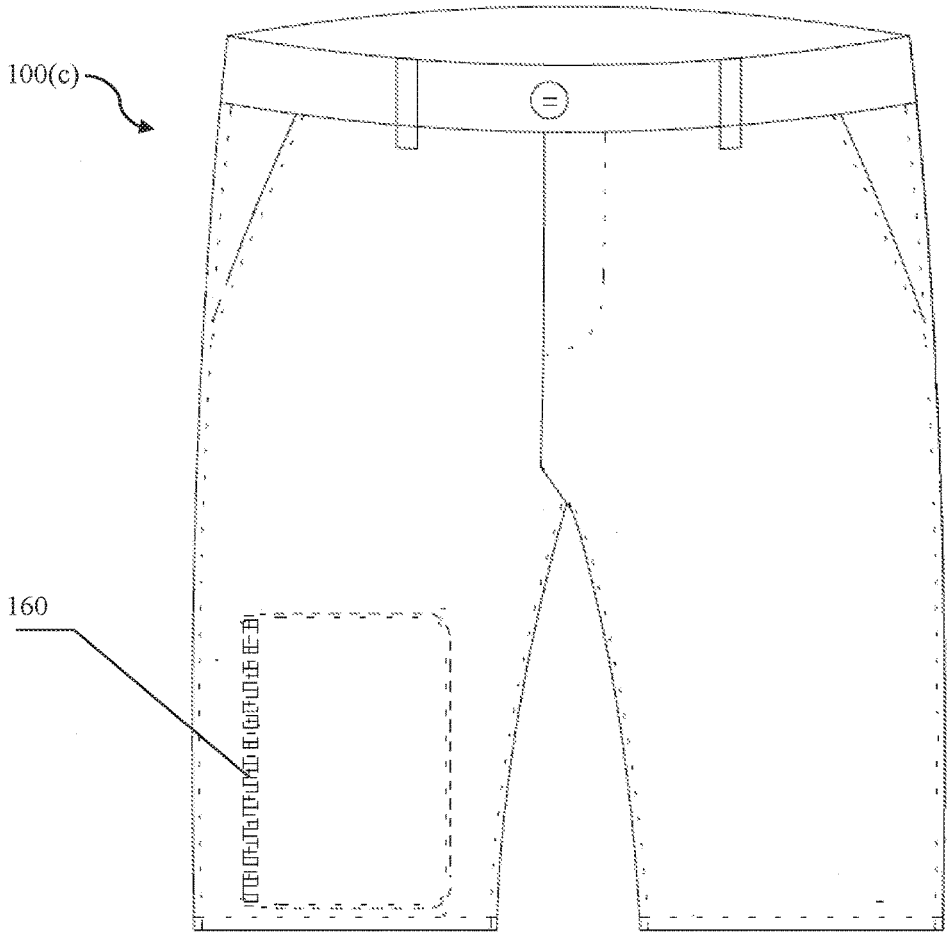
FIG. 1*c* shows a pair of pants with a pocket with a lateral-facing opening on the inside of the pant leg.

In alternative embodiments, pocket 120 can have any other opening, including for example, an opening 150 facing upwards (FIG. 1*b*), an opening 160 sideways (FIG. 1*c*), or an opening 170 diagonally.

Pocket 120 can also be at least partially closed by a hook and loop fastener, a flap, a button, or other sealing device.

Figure 2:
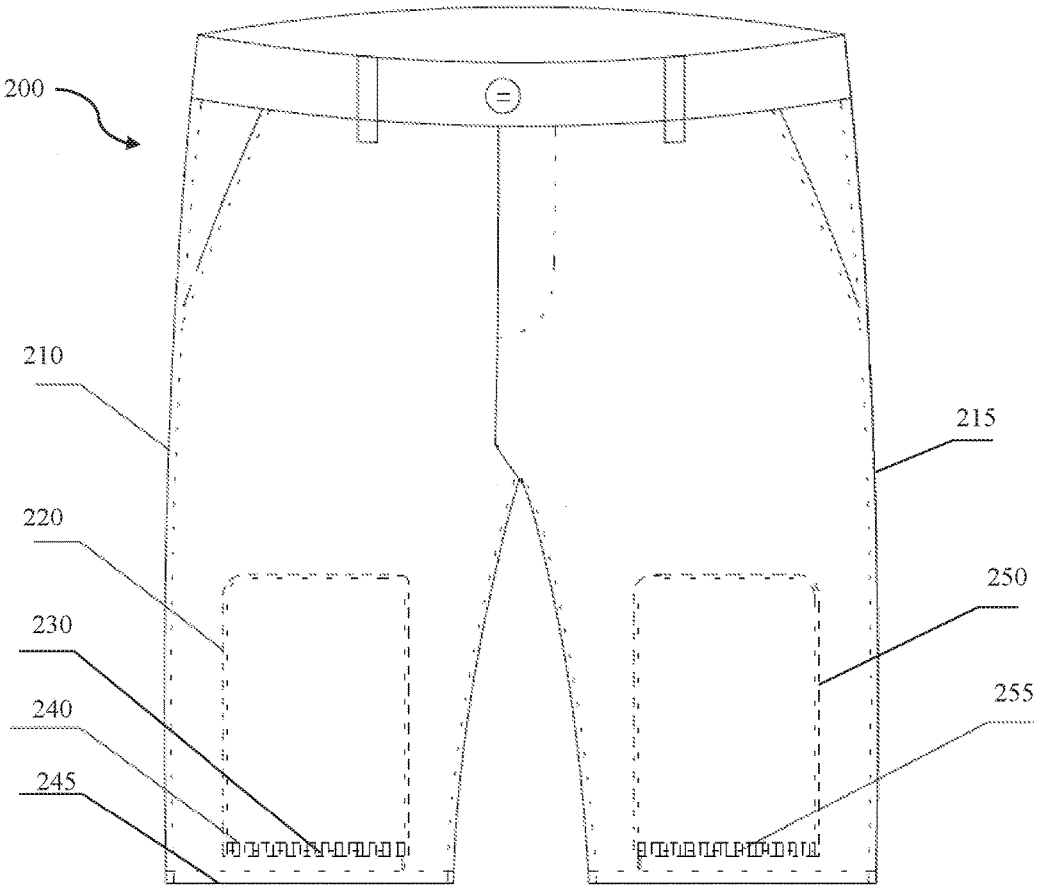
FIG. 2 shows a pair of pants with two pockets, with downward-facing openings on the inside of the pant legs.

FIG. 2 is an embodiment of a pair of pants 200 that has a pocket 220 on the inside of one pant leg 210, and a second pocket 250 on the inside of the other pant leg 215. Pocket 220 has a downward facing opening 230 that can be at least partially closed by a zipper 240. The zipper 240 can be easily accessed from the bottom 245, since the opening 230 is near the bottom 245 of the pant leg 210.

In many embodiments, pocket 250 is symmetrical to pocket 220. In other instances, the pockets 220, 250 have different sizes or shapes.

Figure 3:
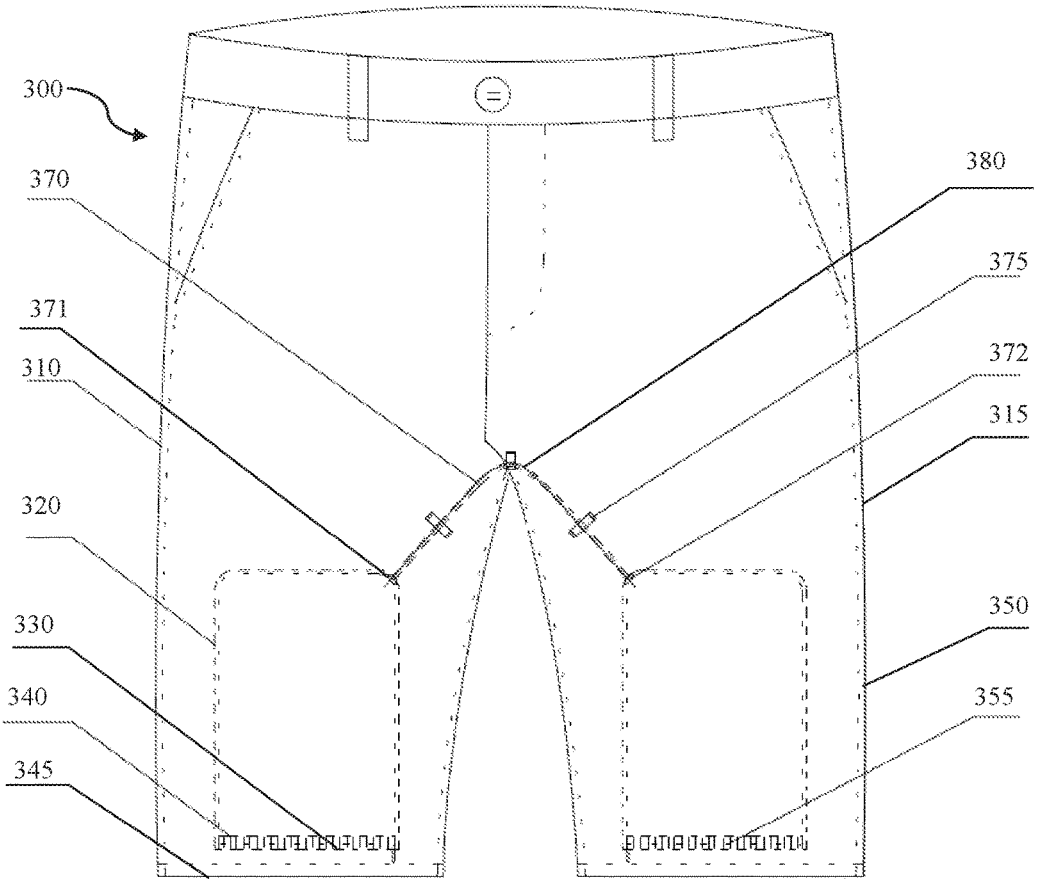
FIG. 3 shows a pair of pants with two pockets, with downward-facing openings on the inside of the pant legs, where the two pockets are connected by a tunnel. A cable is disposed inside the tunnel.

FIG. 3 is preferred embodiment of a pair of pants 300 that has a first pocket 320 on the inside of one pant leg 310, and a second pocket 350 on the inside of the other pant leg 315. Pocket 320 has a downward facing opening 330 that can be at least partially closed by a zipper 340. The opening 330 is less than 10 cm from the bottom 345 of the pant leg 310, so that the zipper 340 can be easily accessed from the bottom 345. Pocket 350 might or might not be symmetrical to pocket 340.

Pockets 320 and 350 are connected by a cable 380. Contemplated cables include a USB cable with outlets compatible with a mobile phone, including an iPhone™, Android™ phone, Google™ phone, etc. The cable 380 is fixed to the pants 300 with at least one fixing member 375. In FIG. 3, the fixing member 375 is a thin, elongated piece of cloth with both ends stitched to the pants 300. The cable 380 runs through the fixing member 375, so that the cable 380 is at least partially fixed to the pants.

Alternatively, pockets 320 and 350 are connected by a tunnel 370. The tunnel 370 has an opening 371 at the corner of pocket 320 and an opening 372 at the corner of pocket 350. The tunnel 370 is made of cloth that forms a tube structure connecting openings 371 and 372. The tunnel 370 is stitched and fixed to the pants 300. The cable 380 runs through the tunnel 370.

Figure 4A:
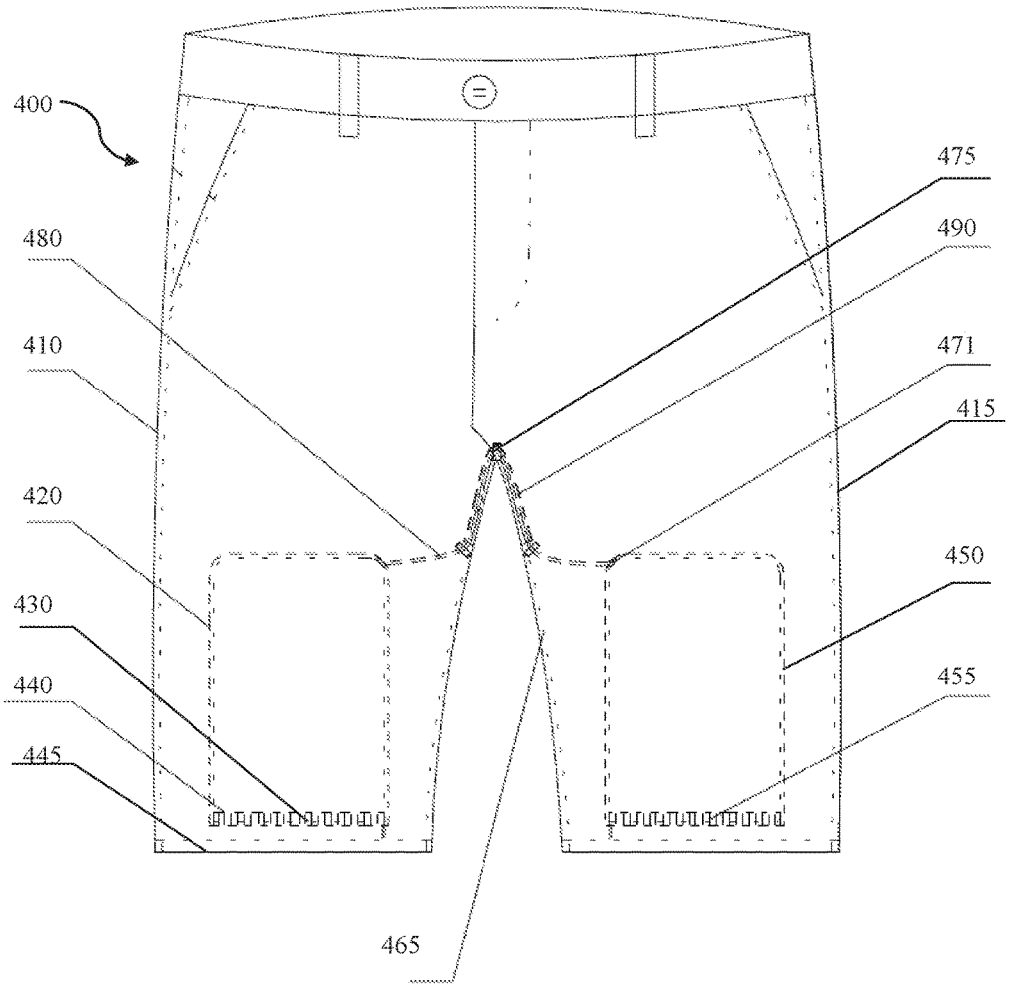
FIG. 4*a* shows a pair of pants with two pockets with downward-facing openings on the inside of the pant legs, where the two pockets are connected by a tunnel coinciding with the folding line, and a cable partially covered by a rubber band.

FIG. 4*a* is another preferred embodiment of a pair of pants 400 that has a pocket 420 on the inside of one pant leg 410, and a second pocket 450 on the inside of the other pant leg 415. Pocket 420 has a downward facing opening 430 and can be at least partially closed by a zipper 440. The opening 430 is less than 10 cm from the bottom 445 of the pant leg 410, so that the zipper 440 can be easily accessed from the bottom 445. Pocket 450 is symmetrical to pocket 440.

Pockets 420 and 450 are connected by a cable 480. The cable 480 is fixed to the pants 400 by at least one fixing member 475. The cable 480 runs along the folding line 465 of the pants 400, so that the cable would impede the movement of the user. The cable 480 is partially covered by a rubber layer 490, thermally insulating the user from the cable 480. Moreover, the rubber layer 490 presses against the cable 480 so that the cable 480 remains elongated and would not twist.

Figure 4B:
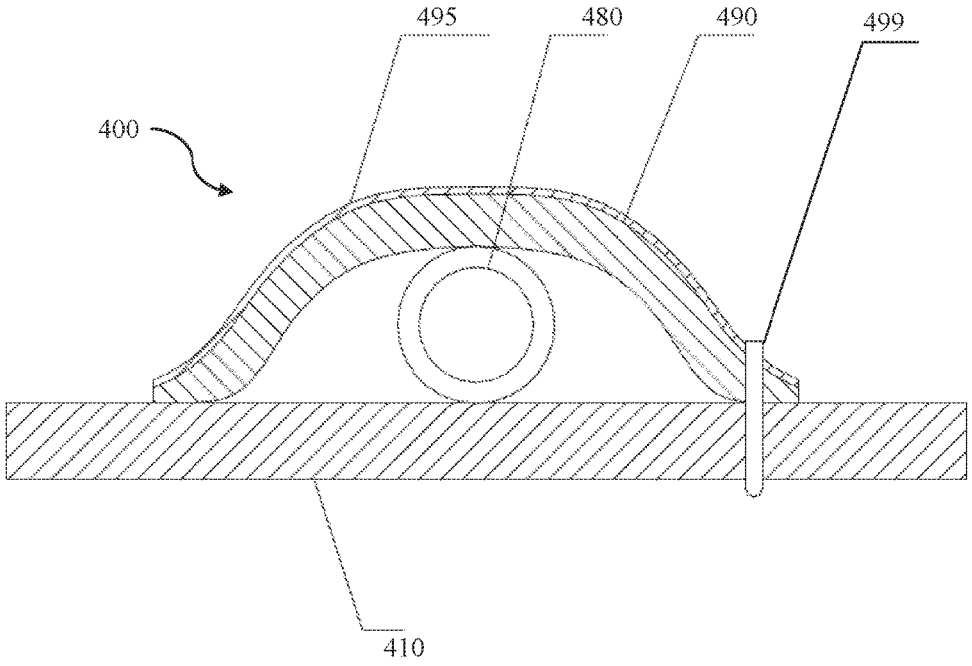
FIG. 4*b* is a cross-sectional view of the tunnel connecting the two pockets in FIG. 4*a*.

FIG. 4*b* is a cross-section view of the rubber layer 490 and the cable 480. In this preferred embodiment, the cross-section of the rubber layer 490 is crescent shaped. The rubber layer 490 is fixed to the pant leg 410 by a fixing member 499. The rubber layer 490 is further covered by a layer of soft and fluffy material 495, to make the user feel comfortable. Contemplated soft materials include fleece, velvet, velour, fur, fake fur, flannel, and so forth.

In some embodiments, a pocket has an electromagnetic radiation shielding layer that can at least partially block electromagnetic radiation produced by an electronic device enclosed within the pocket. The electromagnetic radiation shielding layer is preferably made of a metalized fabric. Metallization can be achieved by any suitable manner, including plating, coating, or impregnating fibers with metal particles. Contemplated metals include iron, silver, gold, copper, nickel, aluminum, bronze, zinc, platinum, chromium, titanium, molybdenum, manganese, and any combination thereof.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A pair of pants, comprising:

a first pant leg and a second pant leg;

a first pocket disposed on an inside surface of the first pant leg, defining a first cavity;

a second pocket disposed on an inside surface of the second pant leg, defining a second cavity; and a tunnel having a first end that opens to the first cavity and a second end that opens to the second cavity; wherein the tunnel connects the first and second pockets together, wherein the first cavity has a first closable opening, and the second cavity has a second closable opening.

2. The pants of claim 1, wherein the first closable opening is facing a waist portion of the pants.

3. The pants of claim 1, wherein the first closable opening is facing opposite of a waist portion of the pants.

4. The pants of claim 1, wherein the first closable opening facing an outseam of the pants.

5. The pants of claim 1, further comprising a flap configured to cover at least a portion of the first closable opening.

6. The pants of claim 1, further comprising a zipper configured to cover at least a portion of the first closable opening.

7. The pants of claim 1, further comprising a button configured to cover at least a portion of the first closable opening.

8. The pants of claim 1, further comprising a hook and loop fastener configured to cover at least a portion of the first closable opening.

9. The pants of claim 1, wherein the first cavity includes a surface area of inside the first pocket at least 60 $cm^2$, disposed against a fabric of the first pant leg.

10. The pants in claim 1, wherein the tunnel coincides with a median seam line of the pants.

11. The pants in claim 1, further comprising a cable inside the tunnel.

12. The pants in claim 11, further comprising a fixing member attached to the first pant leg and coupled to the cable.

13. The pants in claim 11, further comprising a rubber layer that covers at least a portion of the cable.

14. The pants in claim 13, wherein the rubber layer has a crescent cross-sectional shape.

15. The pants in claim 13, further comprising a layer of fleece covering at least a portion of the rubber layer.

16. The pants in claim 13, further comprising a layer of velvet covering at least a portion of the rubber layer.

17. The pants in claim 1, wherein the first pant leg has an inseam of no more than 40 cm.

18. The pants in claim 1, wherein the first closeable opening is on the inside surface of the first pant leg.

* * * * *